US006899562B1

(12) United States Patent
Ruff et al.

(10) Patent No.: US 6,899,562 B1
(45) Date of Patent: May 31, 2005

(54) GROUNDING APPARATUS FOR AN ELECTRONIC MODULE

(75) Inventors: Brian F. Ruff, Lee's Summit, MO (US); Walter J. Rolston, Overland Park, KS (US); David T. Mindrup, Olathe, KS (US)

(73) Assignee: Garmin International, Inc., Olathe, KS (US)

( * ) Notice: Subject to any disclaimer, the term of this patent is extended or adjusted under 35 U.S.C. 154(b) by 0 days.

(21) Appl. No.: 10/284,893

(22) Filed: Oct. 30, 2002

(51) Int. Cl.[7] ..... H01R 13/73
(52) U.S. Cl. ..... 439/571
(58) Field of Search ..... 439/571, 487, 439/579

(56) References Cited

U.S. PATENT DOCUMENTS

| | | | | |
|---|---|---|---|---|
| 3,337,834 A | * | 8/1967 | Godwin et al. | 439/497 |
| 4,130,334 A | | 12/1978 | Anderson | 339/103 |
| 4,310,208 A | * | 1/1982 | Webster et al. | 439/494 |
| H379 H | | 12/1987 | Alexander, Jr. | 439/610 |
| 4,900,261 A | | 2/1990 | Gentry et al. | 439/353 |
| 4,921,441 A | | 5/1990 | Sauder | 439/460 |
| 4,973,259 A | | 11/1990 | Sachs | 439/98 |
| 5,052,947 A | | 10/1991 | Brodie et al. | 439/607 |
| 5,241,135 A | * | 8/1993 | Fetzer | 174/88 R |
| 5,304,964 A | | 4/1994 | DiMarco | 333/181 |
| 5,315,063 A | | 5/1994 | Auclair | 174/78 |
| 5,372,513 A | | 12/1994 | Rodrigues et al. | 439/98 |
| 5,775,924 A | | 7/1998 | Miskin et al. | 439/98 |
| 5,820,412 A | | 10/1998 | Koegel et al. | 439/610 |
| 5,827,078 A | | 10/1998 | Simonian | 439/95 |
| 6,017,245 A | | 1/2000 | Karir | 439/610 |

OTHER PUBLICATIONS

Inotec Electronics Catalog—www.Inotec–electronics.com, pp. 1–32 and additional miscellaneous pages from website.

* cited by examiner

*Primary Examiner*—Phuong Dinh
(74) *Attorney, Agent, or Firm*—Devon A. Rolf

(57) ABSTRACT

An improved device and method for grounding shields of transmission lines is shown. A grounding apparatus, a connector device, and methods associated with them are shown having improved efficiency and reliability among other advantages. Devices and methods shown eliminate a dressing and attaching step of grounding numerous grounding lines to a grounding element such as a connector housing. Devices and methods shown further improve quality and reliability of grounding operations using shielded transmission lines and transmission line connectors.

12 Claims, 3 Drawing Sheets

GROUNDING APPARATUS FOR AN ELECTRONIC MODULE

FIELD OF THE INVENTION

Embodiments of the invention relate generally to apparatus and methods for connecting signal transmission lines. More particularly, embodiments of the invention relate to apparatus and methods for connecting shielded signal transmission lines.

BACKGROUND OF THE INVENTION

Optical, RF, and direct current conductors are often terminated using connector inserts and/or terminals. Such inserts, in turn, are assembled into connectors and provide a convenient interface to power, data, and other forms of energy communicated between various physical locations. The custom of using connectors has given rise to a large industry, and many different types of connectors, designed to accommodate particular circumstances, have become available.

Thus, even those connectors which at first glance appear to be similar can usually be differentiated by any number of user-selectable features. For example, features which can be chosen for most connectors include multiple pin/socket configurations, the use or absence of cable strain relief, and a variety of housing materials (e.g., metal and plastic). Other, more specialized, features made available for some connector types include those enabling efficient assembly, such as crimp-on pins or sockets, and split-housing assemblies.

Connector pricing is competitive, and connectors which can be made in a relatively inexpensive manner, while providing a mix of general and specialized features, are valuable to both vendors and consumers. Thus, there is a need to lower up-front connector costs while increasing the number of user-selectable options. Connector features which enable rapid assembly and repair are especially desirable, since these operations affect the long-term cost of connectors. Connector features which enable rapid assembly and repair are especially desirable, since these operations affect the long-term cost of connectors.

SUMMARY OF THE INVENTION

The above mentioned problems such as rapid assembly and repair, etc. are addressed by the present invention and will be understood by reading and studying the following specification.

A grounding device is shown. The grounding device includes an electrically conductive base portion. The electrically conductive base portion includes a ground contact surface and a line coupling surface. The grounding device also includes a plurality of electrically conducting lines fixed at one end to the line coupling surface.

A shielded electrical connector is also shown. The shielded electrical connector includes a shielded housing. The shielded electrical connector also includes a first number of electrical terminals attached to the shielded housing. The shielded electrical connector also includes a second number of shielded data signal lines attached to the shielded housing, each signal line with a signal carrying portion coupled to one of the first number of electrical terminals. The shielded electrical connector also includes a grounding base removably attached to the shielded housing portion along a ground contact surface. The shielded electrical connector also includes a third number of grounding lines, wherein each of the third number of grounding lines is affixed at a first end to the grounding base, and wherein selected grounding lines are coupled at a second end to a shield portion of each of the second number of shielded data signal lines.

A method of grounding a number of shielded data signal lines is also shown. The method includes coupling a number of shielded data signal lines to a shielded housing, each signal line with a signal carrying portion and a shield portion. The method also includes attaching a number of first ends of a number of ground wires to the shield portions of the number of shielded data signal lines, and attaching a grounding base to the shielded housing, wherein a number of second ends of the number of ground wires are affixed to the grounding base.

A method of manufacturing a grounding device is also shown. The method includes forming an electrically conductive base portion. Forming the electrically conductive base portion includes forming a ground contact surface, and forming a line coupling surface. The method also includes coupling one end of a plurality of electrically conducting lines to the line coupling surface.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

Figure 1A:
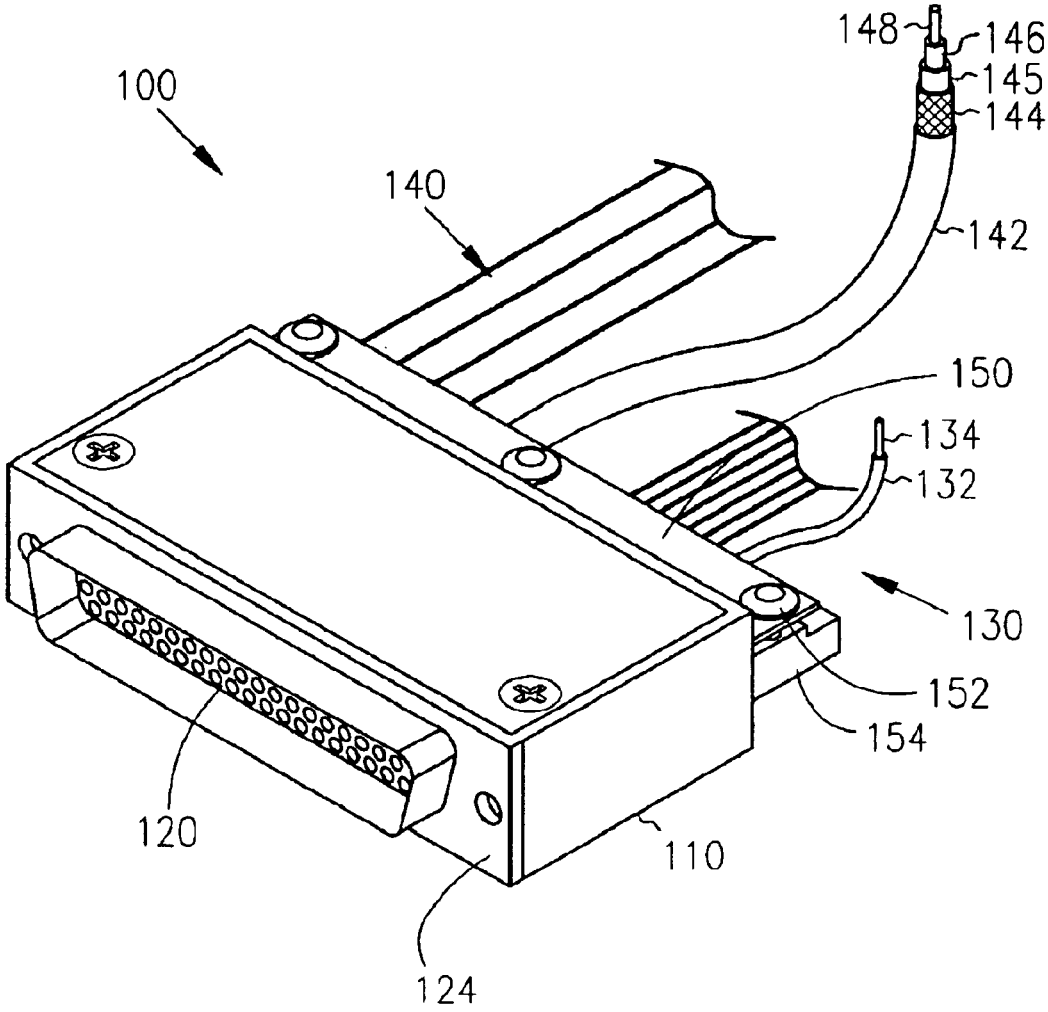
FIG. 1A shows an assembled perspective view of an apparatus according to an embodiment of the invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention.

FIG. 1A shows a transmission line connector 100. The transmission line connector includes a number of terminal connectors 120 coupled to a first number of transmission lines 130 and a second number of transmission lines 140. FIG. 1A shows a male D-sub connector without pins, although the invention is not so limited. Other types of connectors such as a number of female pin connectors, a number of male or female card edge connectors, or other connector types are within the scope of the invention.

In one embodiment, the first number of transmission lines 130 includes a number of electrical transmission lines. Other possible transmission lines include, but are not limited to, optical transmission lines and RF signal transmission lines. In one embodiment, the first number of transmission lines 130 includes a first number of unshielded transmission lines. In one embodiment, the unshielded transmission lines include a conductor portion 134 and an insulator portion 132.

In one embodiment, the second number of transmission lines 140 includes a number of electrical transmission lines. Similar to the first number of transmission lines 130, other possible transmission lines include, but are not limited to, optical transmission lines and RF signal transmission lines. In one embodiment, the second number of transmission lines 140 includes a second number of shielded transmission lines. In one embodiment, the shielded transmission lines include a conductor portion 148, a first insulator portion 146, a shield portion 144 and an outer insulator portion 142. In one embodiment a second insulator portion 145 is included between the first insulator portion 146 and the shield portion 144. In one embodiment, the shield portion 144 includes a metallic mesh. Other shield portions include, but are not limited to wrapped foil, or other shielding materials. In one embodiment, the shields from the second number of transmission lines 140 are grounded to the connector housing 110 as will be described below.

Figure 1B:
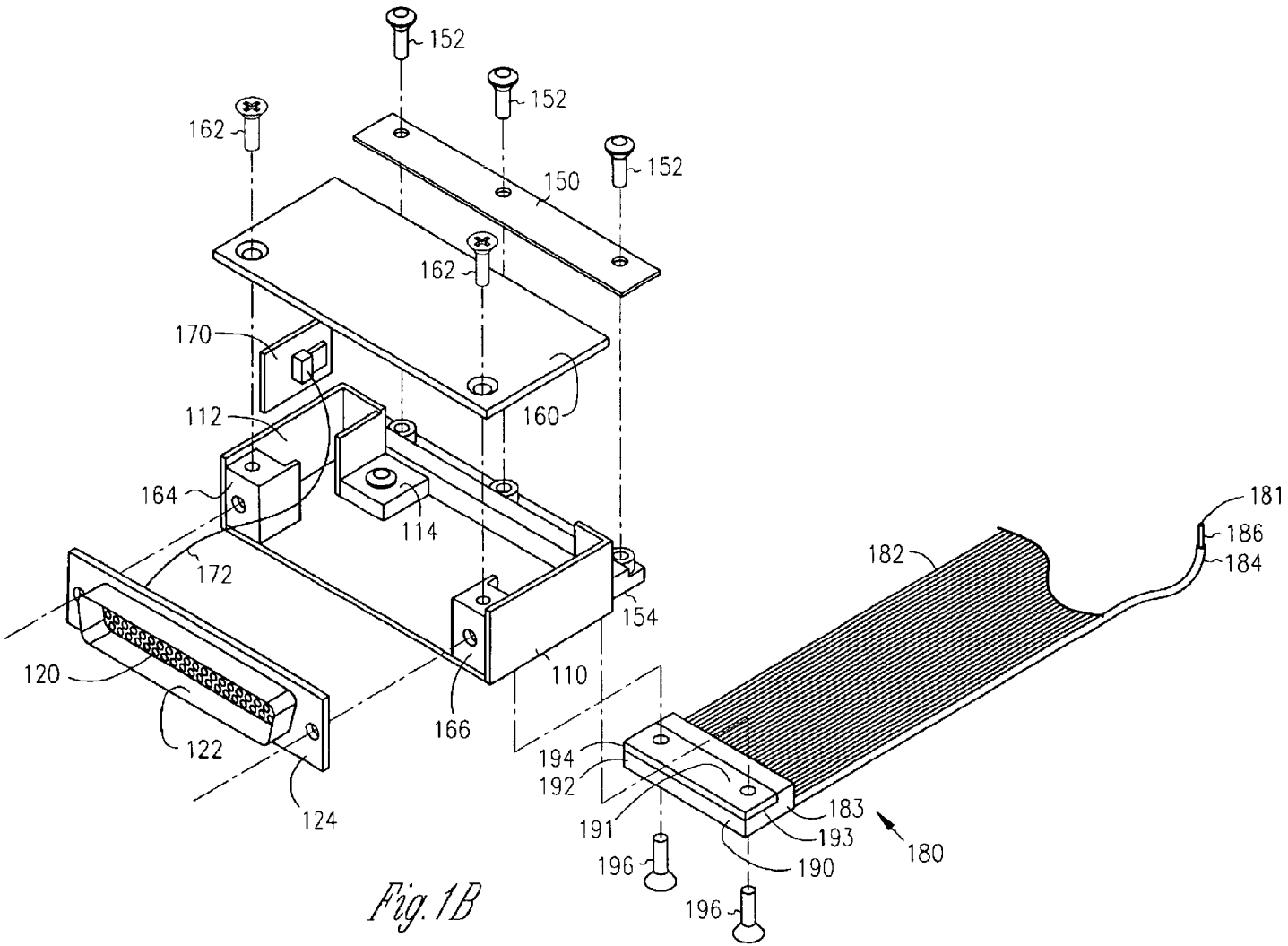
FIG. 1B shows an exploded perspective view of an apparatus, according an embodiment of the invention.

FIG. 1B shows an exploded view of an embodiment of the transmission line connector 100. A connector housing 110 is shown with the number of terminal connectors 120. In one embodiment, the number of terminal connectors 120 are coupled to a terminal plate 124. In one embodiment, the number of terminal connectors 120 are further contained within a shaped housing 122 such as a D-shaped housing. Other forms of shaped housing 122 are also within the scope of the invention. In one embodiment, the terminal plate 124 is fastened to the connector housing 110 using a number of fasteners (not shown). In one embodiment, the number of fasteners includes a number of screws, although other fasteners are also acceptable. In one embodiment, the terminal plate is secured to a first mating region 164 and a second mating region 166. In one embodiment, the number of terminal connectors 120 are attached to an integrally formed region of a connector housing 110 without the use of a terminal plate 124.

A cover plate 160 is further shown in FIG. 1B. The cover plate 160 is secured to the connector housing 110 using a number of fasteners 162. In one embodiment, the number of fasteners 162 include a number of screws. Other methods and devices for enclosing a connector housing 110 are also contemplated within the scope of the invention. Snaps or bayonet fasteners are possible in one embodiment. In one embodiment, elements such as the number of terminal connectors 120 are encased in a molded connector housing 110. One advantage of a removable cover plate 160 includes the ability to service internal components in the connector housing 110. Likewise, removability of individual components allows for their possible repair and replacement.

A transmission line retaining device 150 is further shown. In one embodiment a number of fasteners 152 are used to secure the retaining device to a mating portion 154. In one embodiment, the number of fasteners 152 include a number of screws. In one embodiment, a number of transmission lines are passed between the mating portion 154, and the retaining device 150. The retaining device 150 is then actuated onto the number of transmission lines using the number of fasteners 152. In one embodiment, the retaining device 150 serves as a clamp.

Also shown in FIG. 1B is a circuit module 170. In one embodiment, the circuit module 170 is located in a formed recess 112 of the connector housing 110. The recess 112 serves to securely contain the circuit module within the connector housing. In one embodiment, a transmission line 172 is coupled between the circuit module 170 and selected terminal connectors of the number of terminal connectors 120. In one embodiment, a mounting feature 114 is included within the connector housing 110. One embodiment of a mounting feature 114 includes a threaded hole in combination with a mating screw or bolt. In one embodiment, the mounting feature 114 is configured to accept a device such as a sensor. In one embodiment, the mounting feature 114 is located adjacent to the recess 112 for convenient coupling of a device to the circuit module.

FIG. 1B further shows a grounding device 180. In one embodiment, the grounding device 180 includes a number of grounding lines 182. In one embodiment, each grounding line includes a first end 181 adapted to couple to a shield of a transmission line, and a second end 183 (not shown) adapted to couple to a grounded element. In one embodiment, the second end 183 is conductively joined to a conductive portion 194 and embedded in a molded body 192. Each grounding line, in one embodiment, includes an insulating portion 184 and a conducting portion 186. Several insulating portions are acceptable. One example of an insulating portion 184 includes, but is not limited to, a polymer coating. Likewise, several configurations and materials of conducting portions 186 are acceptable. Examples include, but are not limited to, solid wire, or braided wire, formed from copper, aluminum, etc.

The number of grounding lines 182 are electrically coupled to a common base portion 190. In one embodiment, the base portion 190 includes a conductive portion 194 and a body portion 192. In one embodiment, the conductive portion 194 includes a metal plate. Although a metal is used in one embodiment, other conductive materials are also within the scope of the invention. Although a plate shape of the conductive portion 194 is included in one embodiment, other shapes including portions thicker than plates, arc portions, or-other complex geometry are within the scope of the invention.

In one embodiment, the second end 183 of the number of grounding lines 182 are fixed to a line coupling surface 193 of the conductive portion 194 by soldering the second ends 183 to the conductive portion 194. Other methods of fixing the number of grounding lines 182 to the line coupling surface 193 of the conductive portion 194 include, but are not limited to crimping, brazing, welding, clamping, etc. In one embodiment, the number of grounding lines 182 are molded, or cast into the conductive portion 194. Advantageously, using embodiments as described above, the second end 183 of each of the number of grounding lines 182 can be dressed and attached to the conductive portion 194 using mass production techniques. Resulting quality-control of the attachment of the second end 183 to a grounded element is higher, attachment of the second ends 183 is faster, and later coupling of the second ends 183 by a device installer is made substantially easier.

In one embodiment, the body portion 192 includes an insulating material. In one embodiment the body portion 192 includes a polymeric material. In one embodiment, the body portion 192 includes an injection molded polymer. Other methods of forming the body portion include, but are not limited to potting a thermoset material, machining a material, etc. In one embodiment, the body portion functions concurrently as an insulator and as a mechanical strain relief for at least a portion of the number of grounding lines 182.

In one embodiment, a number of holes are included in the common base portion 190 to accept fasteners 196 such as screws. As shown in FIG. 1B, the fasteners 196 serve to hold a ground contact surface 191 of the conductive portion 194 in electrical communication with a mating surface, therefore establishing a grounded contact. Although holes and fasteners 196 are shown in FIG. 1B, the invention is not so limited. Other attachment devices such as a clip, a crimped element, adhesives, etc are contemplated within the scope of the invention.

Figure 2:
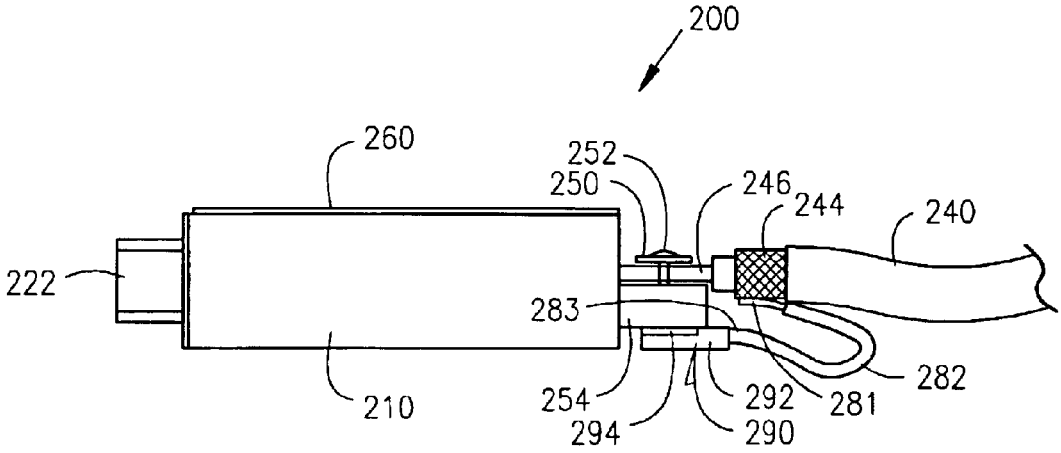
FIG. 2 shows a side view of an apparatus according to an embodiment of the invention.

FIG. 2 shows one embodiment of a connector 200. The connector 200 includes a shielded housing portion 210 with a shaped housing 222 such as a D-shaped housing as described in embodiments above. The shielded housing portion 210 is shown with a cover 260 attached over a top portion of the shielded housing portion 210. At least one shielded transmission line 240 is shown coupled to the connector 200. Multiple shielded transmission lines 240 are included in one embodiment. An insulating portion 246 of an inner conductor portion of the shielded transmission line 240 is shown in a fixed condition. Although a single inner conductor is shown inside a shield portion 244 of a shielded transmission line 240, other embodiments include multiple inner conductors within a shield portion 244 of a shielded transmission line 240. In one embodiment, the insulating portion 246 is clamped to a mating surface 254 of the connector 200 by a clamping plate 250, further using a number of fasteners 252. Although the insulating portion 246 is the portion of the shielded transmission line 240 being clamped in FIG. 2, other embodiments attach to alternate portions of the shielded transmission line 240. Other transmission line retaining devices are also contemplated, and the invention should not be construed as being limited to a clamping configuration.

Further shown in FIG. 2 is a grounding line 282 coupled at a first end 281 to the shield portion 244 of the shielded transmission line 240. In one embodiment, the first end 281 is soldered to the shield portion 244 of the shielded transmission line 240. Other acceptable attachment methods of the first end 281 include, but are not limited to shrink wrapping the first end 281 to the shield portion 244 of the shielded transmission line 240. A second end 283 of the grounding line 282 is coupled to a common base portion 290. The embodiment shown in FIG. 2 includes a common base portion 290 similar to embodiments described above, with a conductive portion 294 and a body portion 292.

In one method of operation, a device installer installs a number of transmission lines, including a number of shielded transmission lines 240 into a connector 200. The number of transmission lines, in one embodiment, also include a number of unshielded transmission lines. The number of transmission lines are coupled to a number of electrical terminals such as terminals 120 as shown in FIGS. 1A and 1B. One of ordinary skill in the art, having the benefit of the present disclosure will recognize that all of the terminals or, only a portion of the terminals may be used. An excess of terminals allows flexibility of a given connector 200 to be used with various numbers of transmission lines and combinations of types of transmission lines, such as shielded and unshielded lines.

Next, the number of transmission lines are appropriately attached to the connector 200 using a device such as a clamping device 250 or other suitable retaining device. The clamping or retaining device 250 adds resilience to the connector 200 in that it keeps transmission lines from pulling out of terminal connections.

The first ends 281 of the grounding lines 282 are then coupled to the shield portions 244 of the shielded transmission lines 240. As discussed above, any of several coupling methods are acceptable, including soldering and shrink wrapping. In one embodiment, similar to embodiments described above, the number of grounding lines 282 are fixed to a common base portion 290. In one embodiment, and excess number of grounding lines 282 are included over the number of shielded transmission lines 240. An excess number of grounding lines 282 allows flexibility in grounding various numbers of shielded transmission lines 240 to various connector configurations 200. In one embodiment, unused grounding lines 282 are trimmed back to a length near the common base portion 290.

Individual coupling at least one grounding line 282 to each shielded transmission line 240 is advantageous because it is easy and efficient to attach to individual lines. It is also advantageous due to issues such as a need to heat to a solderable temperature, and mechanical flexibility/resilience of the individually coupled configuration. It is also advantageous to utilize a number of grounding lines, with a grounding line 282 coupled to each shielded transmission line 240 because of higher connection quality and repeatability with individual attachment. Further, it is advantageous to couple one of a number of grounding lines 282 to each shielded transmission line 240 because if an individual shielded transmission line 240 needs to later be replaced, the single line can be replaced without replacing all transmission lines in the connector 200.

The second ends 283 of the grounding lines 282 are fixed to the common base portion 290 with a conductive portion 294 as discussed in embodiments above. Therefore, all grounding lines 282 are grounded to the connector 200 by attaching the common base portion 290 in a single attachment operation. This is advantageous because it eliminates multiple steps of individually dressing the second ends 283 of the grounding lines 282 and individually attaching the second ends 283 of the grounding lines 282 in a number of separate operations. In one embodiment, the common base portion 290 is attached to a portion of the mating surface 254 on the connector 200. The use of the common base portion 290 is also advantageous because in installation operations such as installing an avionic system behind an aircraft instrument panel, there is frequently limited space in which to work. It is therefore advantageous to couple all second ends 283 of the grounding lines 282 in a single operation.

In one embodiment, a body portion 292 is further included in the common base portion 290. In one embodiment, the body portion 292 is made from a resilient polymer material, and provides a strain relief function that makes the connection at the second ends 283 more robust.

Although an example of an order of steps in an assembly method have been described above, one of ordinary skill in the art having the benefit of the present disclosure will recognize that some or all of the steps can be performed in various alternative orders. The invention is therefore not limited to any particular order.

Conclusion

Thus has been shown a grounding apparatus, a connector device, and methods associated with them having improved efficiency and reliability among other advantages. Devices and methods described above eliminate a dressing and attaching step of grounding numerous grounding lines to a grounding element such as a connector housing. Devices and methods described above further improve quality and reliability of grounding operations using shielded transmission lines and transmission line connectors.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A shielded electrical connector, comprising:

a shielded housing;

a first number of electrical terminals attached to the shielded housing;

a second number of shielded data signal lines attached to the shielded housing, each signal line with a signal carrying portion coupled to one of the first number of electrical terminals;

a grounding base removably attached to the shielded housing along a ground contact surface; and a third number of grounding lines, wherein each of the third number of grounding lines is affixed at a first end to the grounding base, and wherein selected grounding lines are coupled at a second end to a shield portion of each of the second number of shielded data signal lines.

2. The shielded electrical connector of claim 1, wherein selected grounding lines are soldered at a second end to a shield portion of each of the second number of shielded data signal lines.

3. The shielded electrical connector of claim 1, wherein selected grounding lines are shrink wrapped at a second end to a shield portion of each of the second number of shielded data signal lines.

4. The shielded electrical connector of claim 1, wherein the first ends of the third number of grounding lines are cast into the grounding base.

5. The shielded electrical connector of claim 1, wherein the grounding base is removably attached to the shielded housing portion using at least one screw.

6. The shielded electrical connector of claim 1, further including a strain relief portion coupled to the grounding base and to the a third number of grounding lines.

7. The shielded electrical connector of claim 6, wherein the strain relief portion includes an integrally molded polymeric material.

8. The shielded electrical connector of claim 1, wherein at least one of the second number of shielded data signal lines includes multiple signal carrying portions within a single shield portion of a shielded data signal line.

9. A method of grounding a number of shielded data signal lines, comprising:

coupling a number of shielded data signal lines to a shielded housing, each signal line with a signal carrying portion and a shield portion;

attaching a number of first ends of a number of ground wires to the shield portions of the number of shielded data signal lines; and attaching a grounding base to the shielded housing, wherein a number of second ends of the number of ground wires are affixed to the grounding base.

10. The method of claim 9, wherein attaching the number of first ends of the number of ground wires to the shield portions of the number of shielded data signal lines includes soldering a number of first ends of a number of ground wires to the shield portions of the number of shielded data signal lines.

11. The method of claim 9, wherein attaching the number of first ends of the number of ground wires to the shield portions of the number of shielded data signal lines includes shrink wrapping a number of first ends of a number of ground wires to the shield portions of the number of shielded data signal lines.

12. The method of claim 9, wherein attaching the grounding base to the shielded housing includes screwing the grounding base to the shielded housing.

* * * * *